US009821570B2

(12) United States Patent
Naramatsu et al.

(10) Patent No.: US 9,821,570 B2
(45) Date of Patent: Nov. 21, 2017

(54) MEDIUM HEATING DEVICE

(71) Applicant: SEIKO EPSON CORPORATION, Tokyo (JP)

(72) Inventors: Yasuo Naramatsu, Matsumoto (JP); Masahiro Akamine, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 244 days.

(21) Appl. No.: 14/160,308

(22) Filed: Jan. 21, 2014

(65) Prior Publication Data

US 2014/0205959 A1 Jul. 24, 2014

(30) Foreign Application Priority Data

Jan. 22, 2013 (JP) ..... 2013-009020

(51) Int. Cl.
*F27D 3/00* (2006.01)
*B41J 11/00* (2006.01)

(52) U.S. Cl.
CPC ..... *B41J 11/002* (2013.01)

(58) Field of Classification Search
CPC ..... F27D 3/00; B41J 11/02
USPC ..... 432/253
See application file for complete search history.

(56) References Cited

U.S. PATENT DOCUMENTS 3,220,303 A * 11/1965 Stowell ..... G03G 15/321 101/DIG. 37
6,328,440 B1 * 12/2001 Medin ..... B41J 11/002 271/7
6,796,648 B2 * 9/2004 Ohashi ..... B41J 11/06 347/104
7,048,354 B2 * 5/2006 Kawatoko ..... B41J 11/005 347/37
7,641,330 B2 * 1/2010 Ozaki ..... B65H 5/38 347/104
2003/0132978 A1 * 7/2003 Hinojosa ..... B41J 2/01 347/16
2004/0257421 A1 * 12/2004 Yokoyama ..... B41J 2/1721 347/104
2011/0285799 A1 * 11/2011 Okura ..... B41J 11/0005 347/102
2012/0050434 A1 3/2012 Hokazono
2012/0050435 A1 * 3/2012 Sugiyama ..... B41J 15/165 347/102

(Continued)

FOREIGN PATENT DOCUMENTS

JP 10-217572 8/1998
JP 2003-237043 8/2003

(Continued)

OTHER PUBLICATIONS

JP2004050546A—machine translation.*
JP2007145503A—machine translation.*

*Primary Examiner* — Nathaniel Herzfeld
(74) *Attorney, Agent, or Firm* — Workman Nydegger

(57) ABSTRACT

A medium heating device includes a heater that heats a medium, and a medium support member that supports a target heating portion, which is a portion that is heated by the heater in the medium, in which the medium support member has a first component portion that is formed so that a space is provided between the medium and the first component portion when the medium is supported, and a second component portion that is in contact with the medium when the medium is supported.

6 Claims, 6 Drawing Sheets

(56) References Cited

U.S. PATENT DOCUMENTS

| | | | | |
|---|---|---|---|---|
| 2013/0063534 | A1* | 3/2013 | Akamine | B41J 11/002<br>347/102 |

FOREIGN PATENT DOCUMENTS

| | | | | |
|---|---|---|---|---|
| JP | 2004050546 | A | * | 2/2004 |
| JP | 2007-145503 | | | 6/2007 |
| JP | 2007145503 | A | * | 6/2007 |
| JP | 2010-210911 | | | 9/2010 |
| JP | 2012-045897 | | | 3/2012 |
| JP | 2012-179802 | | | 9/2012 |

* cited by examiner

MEDIUM HEATING DEVICE

BACKGROUND

1. Technical Field

The present invention relates to a medium heating device.

2. Related Art

Medium heating devices that have a heater that heats a medium, and a medium support member that supports a target heating portion of the medium are already well known. For example, it is possible to include liquid discharging apparatuses such as ink jet printers as an example of such medium heating devices, and in this case, the medium is heated in order to cure liquid that has been discharged onto the medium.

JP-A-2012-179802 is an example of the related art.

In the related art, there was a problem in that when a medium is heated by a heater, heat would escape from a target heating portion of the medium to a medium support member that is supporting the target heating portion, and as a result, the heating of the medium would not be performed suitably.

SUMMARY

An advantage of some aspects of the invention is that heating of a medium is performed suitably.

According to an aspect of the invention, there is provided a medium heating device including a heater that heats a medium, and a medium support member that supports a target heating portion, which is a portion that is heated by the heater in the medium, in which the medium support member has a first component portion that is formed so that a space is provided between the medium and the first component portion when the medium is supported, and a second component portion that is in contact with the medium when the medium is supported.

Other features of the invention will be described using the statements of the specification and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
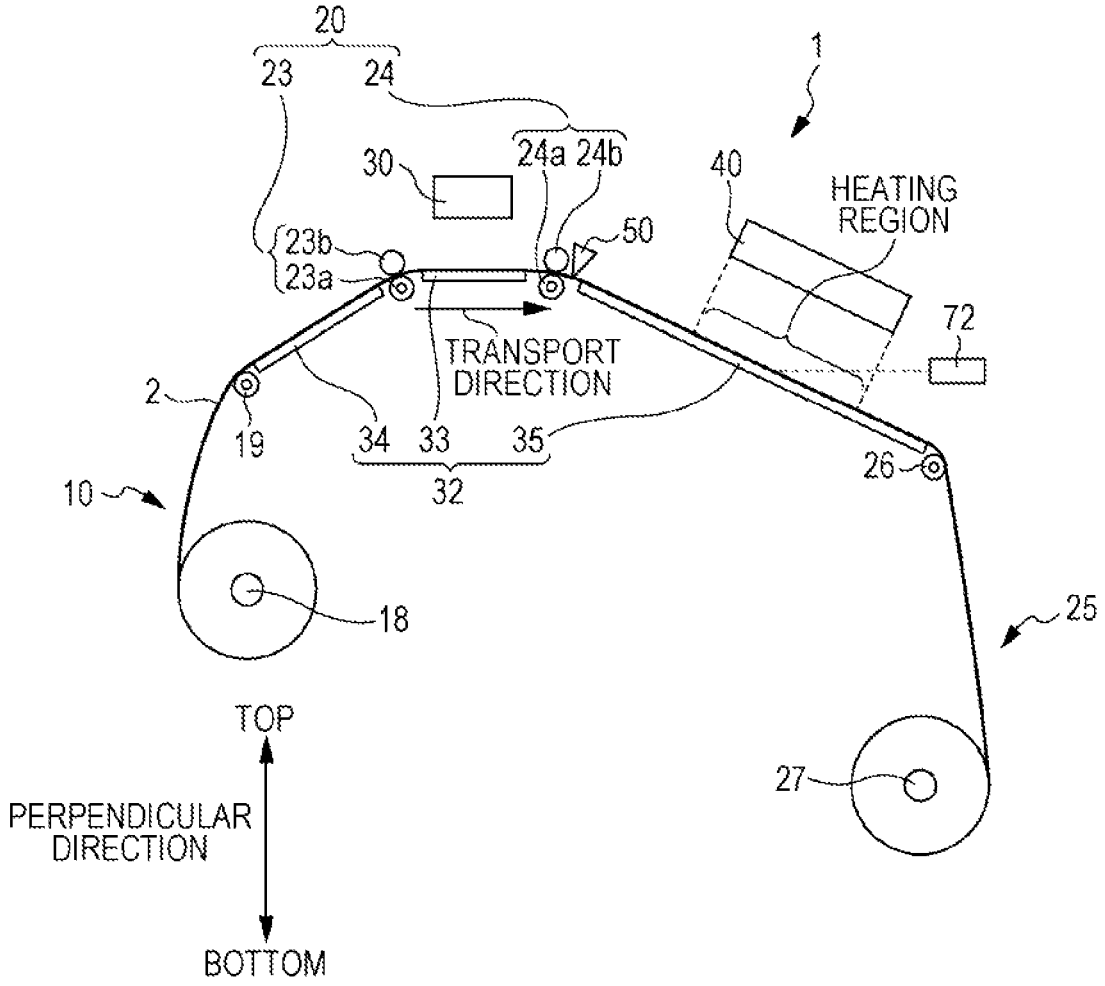
FIG. 1 is a schematic view that shows a configuration example of a printer.

The following points will be made clear by the specification and the appended drawings.

According to an aspect of the invention, there is provided a medium heating device including a heater that heats a medium, and a medium support member that supports a target heating portion, which is a portion that is heated by the heater in the medium, in which the medium support member has a first component portion that is formed so that a space is provided between the medium and the first component portion when the medium is supported, and a second component portion that is in contact with the medium when the medium is supported.

According to the medium heating device, it is possible to suitably perform the heating of the medium.

In addition, the first component portion may be formed so as to become depressed with respect to the second component portion in a direction that is separated from the medium when the medium support member supports the medium.

In this case, it is possible to suitably perform the heating of the medium.

In addition, the medium heating device may further include a transport portion that transports the medium in a transport direction, and a plurality of the first component portions and second component portions may be provided in the medium support member along the transport direction.

In this case, it is possible to more effectively control a phenomenon in which heat is lost.

In addition, the first component portion and the second component portion may be provided alternately in the medium support member.

In this case, it is possible to more effectively control a phenomenon in which heat is lost.

In addition, a cross-section of the medium support member that has an intersecting direction as the normal line thereof may be step-shaped.

In this case, it is possible to suitably realize a configuration of a medium support member in which an air layer is formed.

In addition, the medium heating device may further include a feeding portion that feeds the medium and is provided with a first shaft around which the medium is rolled, and a winding portion that winds the medium and is provided with a second shaft around which the medium is rolled, and in a state in which the medium is rolled on both the first shaft and the second shaft, the medium may be in contact with the second component portion of the medium support member.

In this case, a phenomenon in which a deformed medium that results from being heated sags downward can be suitably prevented since downward sag is physically blocked by the second component portion.

In addition, the medium support member may be a first medium support member, the medium heating device may further include a second medium support member that supports portions other than the target heating portion of the medium, and notches may be provided in the second medium support member.

In this case, it is possible to suppress a problem in which the medium sticks to the medium support member using a simple process.

Example of the Overall Configuration of Printer 1

Figure 2:
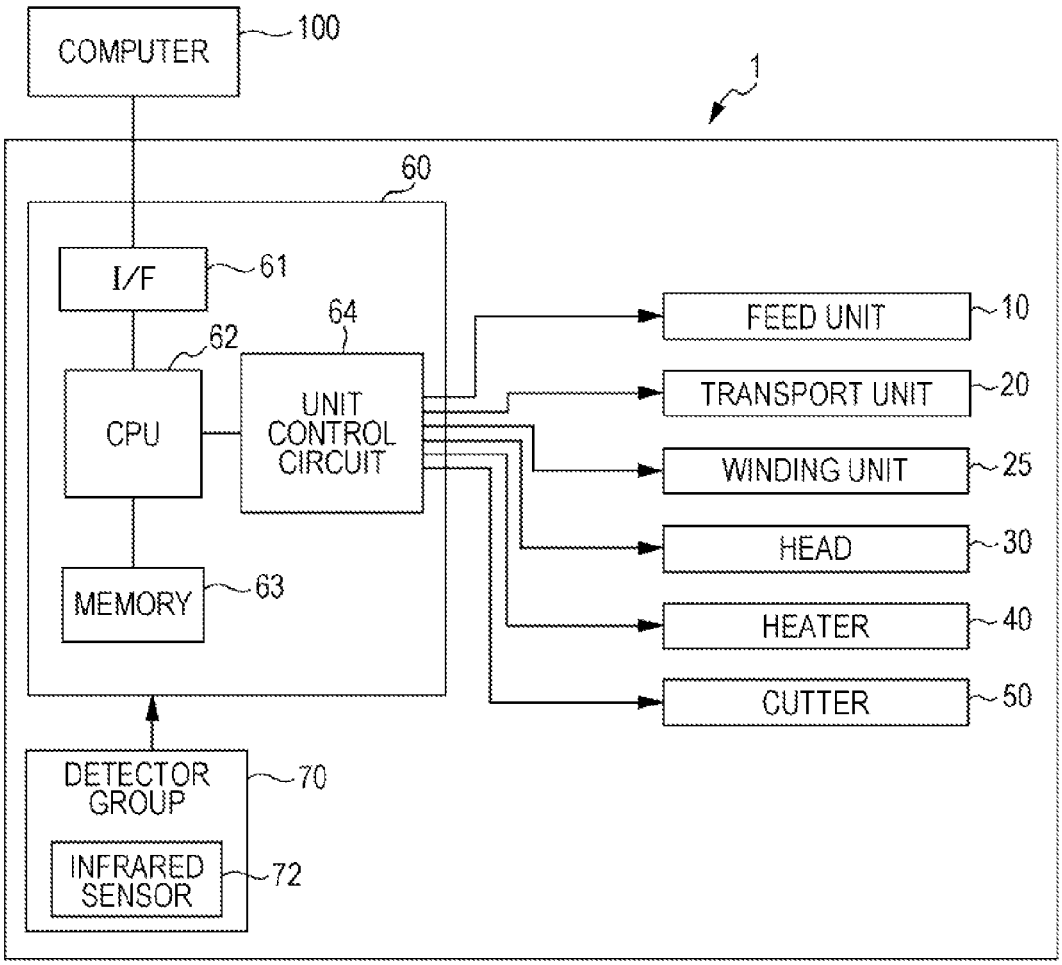
FIG. 2 is a block diagram of an overall configuration of the printer.

FIG. 1 is a schematic view that shows a configuration example of an ink jet printer (hereinafter, simply referred to as a printer 1) as an example of a medium heating device. FIG. 2 is a block diagram of an overall configuration of the printer 1.

As shown in FIGS. 1 and 2, the printer 1 according to the embodiment has a feed unit 10 as an example of a feeding portion, a transport unit 20 as an example of a transport portion, a winding unit 25 as an example of a winding portion, a head 30, a roll-shaped medium support body 32, a heater 40, a cutter 50, a controller 60 and a detector group 70.

The feed unit 10 feeds a roll-shaped medium 2 as an example of a medium into the transport unit 20. As shown in FIG. 1, the feed unit 10 has a roll-shaped medium rolling shaft 18 (corresponds to a first shaft) upon which a roll-shaped medium 2 is rolled and rotatably supported, and a relay roller 19 for taking in a roll-shaped medium 2 that is delivered from the roll-shaped medium rolling shaft 18 and guiding the roll-shaped medium 2 to the transport unit 20.

The transport unit 20 transports a roll-shaped medium 2 sent by the feed unit 10 in a transport direction along a transport pathway that is set in advance. As shown in FIG. 1, the transport unit 20 has a first transport roller 23, and a second transport roller 24 that is positioned on the downstream side of the transport direction when viewed from the first transport roller 23. The first transport roller 23 has a first driving roller 23*a* that is driven by a motor (not shown in the drawings) and a first driven roller 23*b* that is disposed so as to face the first driving roller 23*a* with a roll-shaped medium 2 interposed therebetween. In the same manner, the second transport roller 24 has a second driving roller 24*a* that is driven by a motor (not shown in the drawings) and a second driven roller 24*b* that is disposed so as to face the second driving roller 24*a* with a roll-shaped medium 2 interposed therebetween.

The winding unit 25 is for winding a roll-shaped medium 2 (a roll-shaped medium 2 on which image recording has been completed) that is sent by the transport unit 20. As shown in FIG. 1, the winding unit 25 has a relay roller 26 for taking in a roll-shaped medium 2 sent from the second transport roller 24 and transporting the roll-shaped medium 2 from the upstream side of the transport direction to the downstream side of the transport direction, and a roll-shaped medium winding drive shaft 27 (corresponds to a second shaft) that winds a rotatably supported roll-shaped medium 2 sent from the relay roller 26.

The head 30 is for recording (printing) images in a locus of a roll-shaped medium 2 that is positioned in an image recording area on the transport pathway. That is, as shown in FIG. 1, the head 30 forms images by discharging ink as an example of a liquid from ink discharge nozzles onto a roll-shaped medium 2 fed onto a platen 33 (to be described later) by the transport unit 20.

Additionally, a piezoelectric element (not shown in the drawings) is provided in the ink discharge nozzles as an example of a driving element for discharging ink droplets. When a voltage is applied between electrodes provided on both sides of the piezoelectric element for a predetermined period of time, the piezoelectric element stretches in proportion with the application time of the voltage, and the side walls of an ink flow channel are deformed. As a result of this configuration, the volume of the ink flow channel is contracted in proportion with the stretching of the piezoelectric element, and an amount of ink that corresponds to this contracted portion forms ink droplets and is discharged from the ink discharge nozzles.

The roll-shaped medium support body 32 is for supporting a roll-shaped medium 2 from below. The roll-shaped medium support body 32 is metallic (more specifically, the roll-shaped medium support body 32 is made from aluminum). In the embodiment, as shown in FIG. 1, a platen 33 that faces the head 30, an upstream side support member 34 that is positioned on the upstream side of the platen 33 in the transport direction, and a downstream side support member 35 that is positioned on the downstream side of the platen 33 in the transport direction are provided as the roll-shaped medium support body 32.

The heater 40 is for curing ink by heating a roll-shaped medium 2 (in other words, ink on a roll-shaped medium 2). The heater 40 is an infrared heater that irradiates infrared light, and as shown in FIG. 1, is provided in a position that faces the downstream side support member 35. In other words, the heater 40 heats a roll-shaped medium 2 that is supported on the downstream side support member 35.

The cutter 50 is for cutting the roll-shaped medium 2. The cutter 50 cuts away a roll-shaped medium 2 on which image recording has been completed from a roll-shaped medium 2 on which image recording is yet to be performed by cutting the roll-shaped medium 2 when a non-winding mode (to be described later) is being executed. As shown in FIG. 1, the cutter 50 is provided between the head 30 and the heater 40 in the transport direction.

In addition, as shown in FIG. 2, the printer 1 is provided with a controller 60 that manages the actions of the printer 1 by controlling the abovementioned units and the like, and a detector group 70. The printer 1 that has received printing instructions (print data) from a computer 100, which is an external device, controls each unit (the feed unit 10, the transport unit 20, the winding unit 25, the head 30, the heater 40 and the cutter 50) using the controller 60. The controller 60 prints images on the roll-shaped medium 2 by controlling each unit on the basis of print data received from the computer 100. The status inside the printer 1 is monitored by the detector group 70, and the detector group 70 outputs a detection result to the controller 60. The controller 60 controls each unit on the basis of the detection result output from the detector group 70.

Additionally, as shown in FIGS. 1 and 2, in the printer 1 according to the embodiment, an infrared sensor 72 is provided as the detector group 70. The infrared sensor 72 detects the energy of infrared light by sensing on a surface of the roll-shaped medium 2 within a heating region of the heater 40 (in other words, an irradiation region. Refer to FIG. 1). Further, the irradiation energy of the heater 40 is controlled by the controller 60 on the basis of the energy detected by the infrared sensor 72.

The controller 60 is a control unit for performing control of the printer 1. The controller 60 has an interface unit 61, a CPU 62, a memory 63 and a unit control portion 64. The interface unit 61 performs the transmission and reception of data between the computer 100, which is an external device and the printer 1. The CPU 62 is a computational processing device for performing control of the entire printer 1. The memory 63 is for securing areas that store a program of the CPU 62, a working area and the like, and has storage elements such as RAM, which is volatile memory and EEPROM which is non-volatile memory. The CPU 62 controls each unit according to the program that is stored in the memory 63 using the unit control portion 64.

Execution Modes of Printer 1

Figure 3:
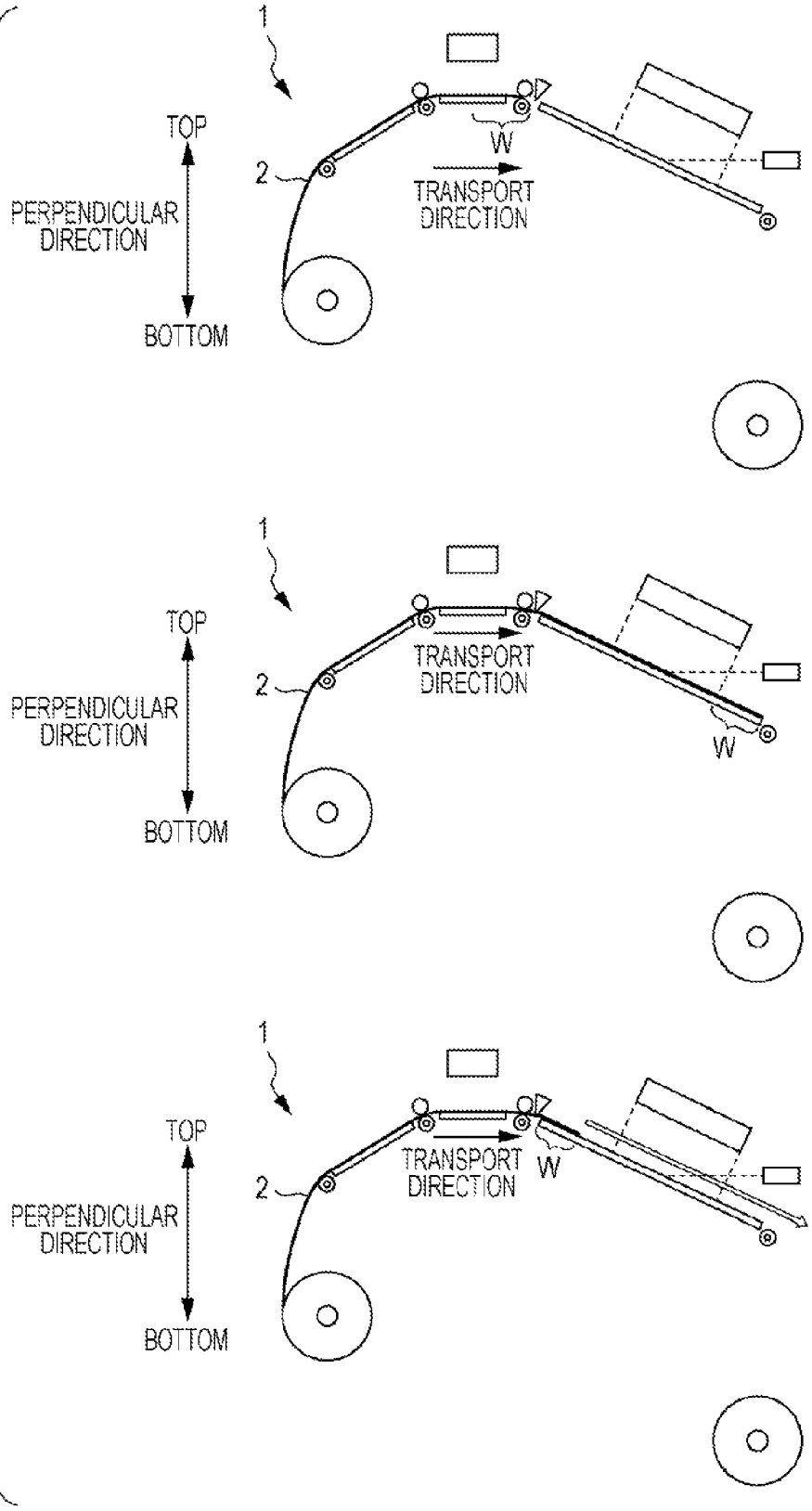
FIG. 3 is an explanatory view for describing a non-winding mode.

Next, a winding mode and a non-winding mode, which are execution modes of the printer 1 according to the embodiment, will be described using FIGS. 1 and 3. FIG. 3 is an explanatory view for describing a non-winding mode. Additionally, since a state in which the winding mode is being executed is displayed in FIG. 1, the winding mode will be described while continuing to refer to FIG. 1.

The printer 1 according to the embodiment is provided with a non-winding mode, in which the winding unit 25 is not used and a roll-shaped medium 2 on which image recording has been completed is not wound by the roll-shaped medium winding drive shaft 27, and a winding mode, in which the winding unit 25 is used and a roll-shaped medium 2 on which image recording has been completed is wound by the roll-shaped medium winding drive shaft 27, as execution modes. That is, the controller 60 executes a winding mode in which a roll-shaped medium 2 that has been transported by the transport unit 20 is wound by the winding unit 25 and a non-winding mode in which a roll-shaped medium 2 that has been transported by the transport unit 20 is not wound by the winding unit 25.

When the winding mode is executed, as shown in FIG. 1, a roll-shaped medium 2 is retained in a state of being rolled around both the feed unit 10 and the winding unit 25 (the roll-shaped medium rolling shaft 18 and the roll-shaped medium winding drive shaft 27), and is transported by the transport unit 20.

Further, the locus of a roll-shaped medium 2 that has been fed from the roll-shaped medium rolling shaft 18 eventually reaches a position that faces the head 30, and images are formed in a corresponding locus at the position. When the roll-shaped medium 2 is further transported, the locus at which images are formed eventually reaches a position that faces the heater 40, and a corresponding locus at the position is irradiated with infrared light. Further, by transporting the roll-shaped medium 2 further still, the locus reaches the winding unit 25, and is wound by the roll-shaped medium winding drive shaft 27.

On the other hand, when the non-winding mode is executed, as shown in FIG. 3, a roll-shaped medium 2 is retained in a state of being rolled around the feed unit 10 only, and is transported by the transport unit 20.

Further, the locus of a roll-shaped medium 2 that has been fed from the roll-shaped medium rolling shaft 18 reaches a position that faces the head 30, and images (an example of an image formation region on the roll-shaped medium 2 is shown with a W symbol in FIG. 3) are formed (a state in which image formation has been completed is shown in the top drawing of FIG. 3) in a corresponding locus at the position.

By further transporting the roll-shaped medium 2, the image formation region W reaches a position that faces the heater 40, and the image formation region W at the position is irradiated with infrared light (a state in which infrared irradiation of the image formation region W has been completed is shown in the middle drawing of FIG. 3).

Next, the roll-shaped medium 2 is transported in the opposite direction (back fed) by the transport unit 20. When this happens, the image formation region W returns to a position in front of the cutter 50, and the roll-shaped medium 2 is cut by the cutter 50 (refer to the bottom drawing of FIG. 3). Further, as a result of this, the roll-shaped medium 2 on which image recording has been completed is cut away from a roll-shaped medium 2 on which image recording is yet to be performed, and moves toward the direction of the long white arrow (paper ejection) while sliding on the downstream side support member 35.

Shape of Downstream Side Support Member 35

Figure 4:
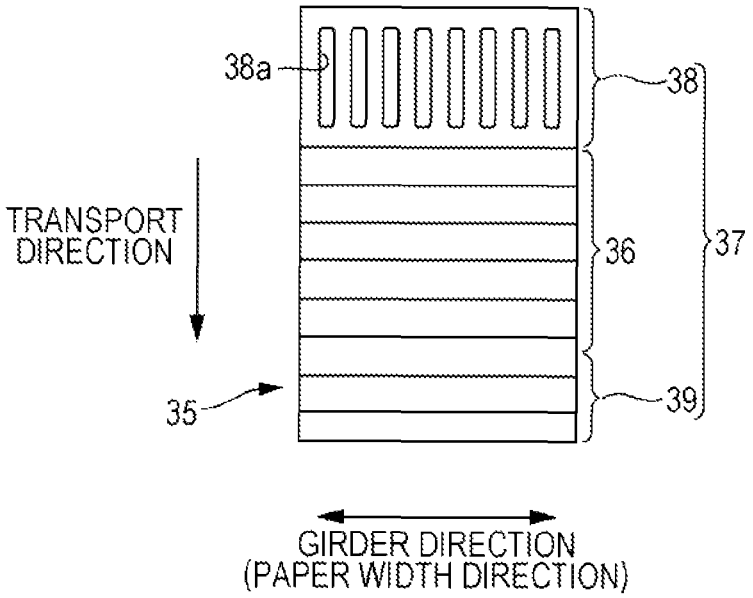
FIG. 4 is a schematic view of when a downstream side support member is viewed from above.
Figure 5:
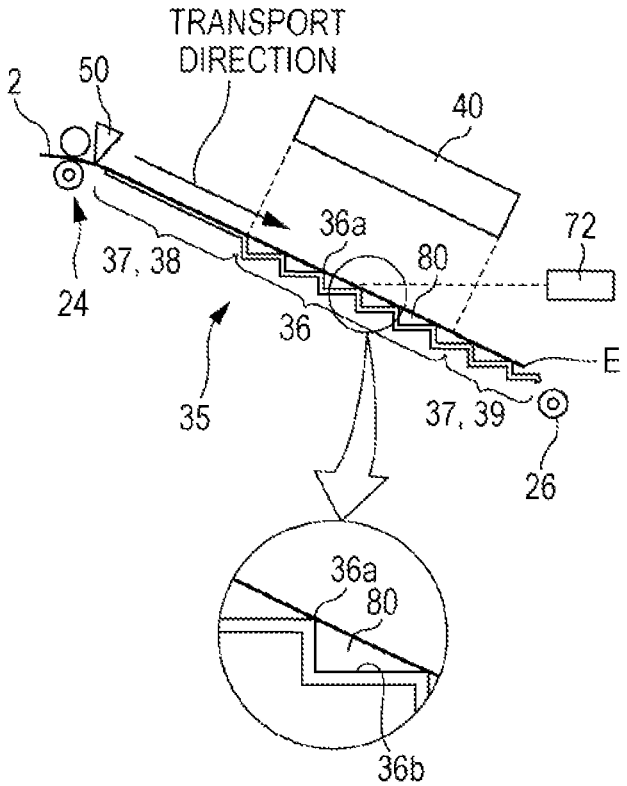
FIG. 5 is a schematic cross-sectional view that shows the state at the periphery of the downstream side support member when the non-winding mode is executed.
Figure 6:
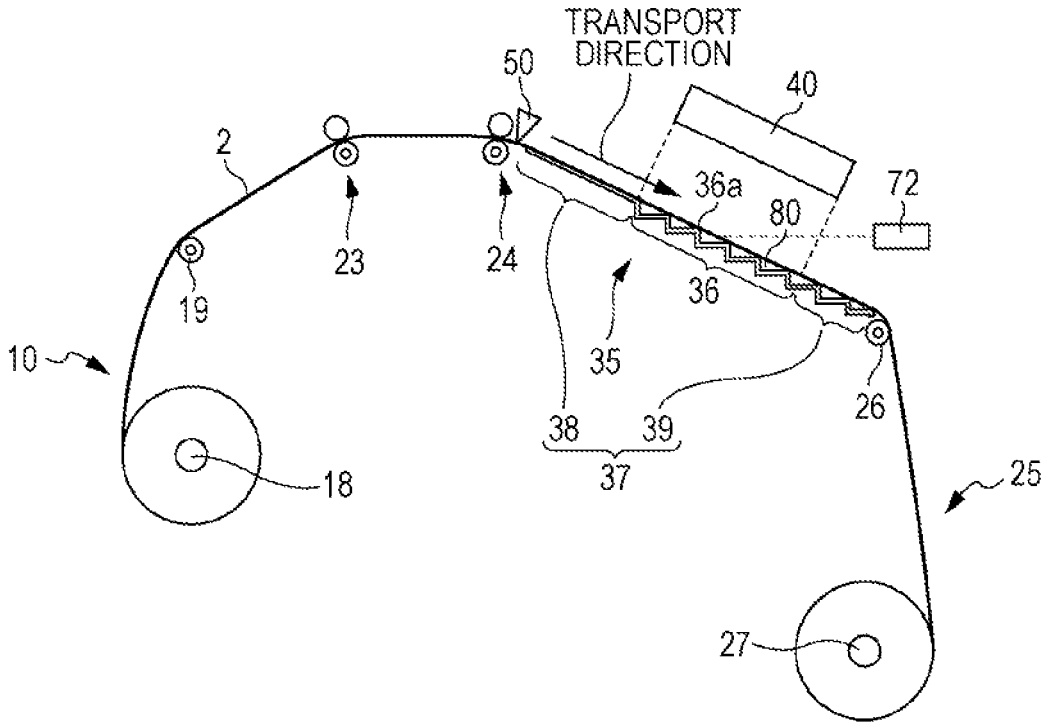
FIG. 6 is a schematic cross-sectional view that shows the state at the periphery of the downstream side support member when a winding mode is executed.

The downstream side support member 35 according to the embodiment corresponds to a medium support member that supports a medium. The shape of the downstream side support member 35 will be described using FIGS. 4 to 6. FIG. 4 is a schematic view of when the downstream side support member 35 is viewed from above. FIG. 5 is a schematic cross-sectional view that shows the state at the periphery of the downstream side support member 35 when the non-winding mode is executed. FIG. 6 is a schematic cross-sectional view that shows the state at the periphery of the downstream side support member 35 when the winding mode is executed.

Additionally, a state of a cross-section of the downstream side support member 35 is also shown in FIG. 1, but the downstream side support member 35 of FIG. 1 is a downstream side support member in which the downstream side support member 35 of FIGS. 5 and 6 has been further schematically altered. In addition, the reason why the downstream side support member 35 has been given this shape is will be described in detail in the next section (rather than this section).

In the abovementioned manner, the heater 40 heats a roll-shaped medium 2 that is supported by the downstream side support member 35. Therefore, a portion of the roll-shaped medium 2 that is heated (in other words, a portion of the roll-shaped medium 2 that corresponds to the abovementioned heating region (see FIG. 1). Hereinafter, referred to as a target heating portion) is supported by the downstream side support member 35. Meanwhile, the downstream side support member 35 also supports portions of the roll-shaped medium other than the target heating portion. Further, the downstream side support member 35 according to the embodiment has a target heating portion support section 36 (corresponds to a first medium support member) that supports a target heating portion of the roll-shaped medium 2, and a non-target heating portion support section 37 (corresponds to a second medium support member) that supports portions other than the target heating portion of the roll-shaped medium 2, that have characteristic shapes and are different from one another.

Firstly, the shape of the target heating portion support section 36 will be described.

As shown in FIG. 5, the target heating portion support section 36 is provided with a plurality of contact portions **36*a* (corresponds to a second component portion) that are in contact with the roll-shaped medium 2 and hold the roll-shaped medium 2 up and a plurality of depressed portions 36*b* (corresponds to a first component portion) which are depressed with respect to the contact portions 36*a* in a direction that is separated from the roll-shaped medium 2. In other words, the first component portion is formed so as to become depressed with respect to the second component portion in a direction that is separated from the medium when the medium support member is supporting a medium. Further, the plurality of contact portions 36*a* and depressed portions 36*b* are lined up in step-form. That is, a cross-section (that is, the cross-section that is shown in FIG. 5) of the target heating portion support section 36** that has a girder direction (in other words, a width direction of the medium), which is the intersecting direction that intersects the transport direction, as the normal line thereof is provided with a stepped shape.

In addition, as shown in FIG. 5, while the target heating portion support section 36 is provided with the contact portions **36*a* and the depressed portions 36*b* in the transport direction, the target heating portion support section 36 is flat in the girder direction (the width direction of the medium). That is, as shown in FIG. 4, the contact portions 36*a* and the depressed portions 36*b*** are not provided in the girder direction (the width direction of the medium).

Further, since the target heating portion support section 36 is provided with such contact portions 36*a* and depressed portions 36*b*, as shown in FIG. 5, an air layer 80, that is, an airspace is provided between the roll-shaped medium 2 and the target heating portion support section 36. That is, the target heating portion support section 36 forms an air layer 80 between the roll-shaped medium 2 and the depressed portions 36*b*.

In this case, the shape of the downstream side support member 35 is not limited to a stepped shape, and may have a form which is provided with a first component portion that is formed so that an airspace is provided between the a medium and the downstream side support member 35 when the medium is supported, and a second component portion that is in contact with the medium when the medium is supported. If such a configuration is adopted, the contact region of the medium and the medium support member is greatly reduced, and it is possible to suppress a phenomenon in which heat is lost through a contact portion. Furthermore, a shape that satisfies the following conditions is preferable. 1: The first component portion and the second component portion in the medium support member have a shape that is provided in a plurality along the transport direction. 2: The first component portion and the second component portion in the medium support member be provided alternately. If such a configuration is adopted, it is possible to more effectively suppress a phenomenon in which heat is lost.

Next, the shape of the non-target heating portion support section 37 will be described.

The embodiment has a first non-target heating portion support section (hereinafter, abbreviated as a first portion 38), which is positioned on the upstream side when viewed from the target heating portion support section 36, and a second non-target heating portion support section (hereinafter, abbreviated as a second portion 39), which is positioned on the downstream side, as the non-target heating portion support section 37.

As shown in FIG. 4, a plurality of notches 38*a* (in this instance, the term notches is used generally and can include a broad range including holes) are provided in the first portion 38. The notches 38*a* have a long, thin shape, and the longitudinal direction thereof is along the transport direction. Further, the plurality of notches 38*a* are lined up in the girder direction (the width direction of the medium).

On the other hand, a stepped shape is provided in the second portion 39 in a form in which the stepped shape of the target heating portion support section 36 is continuous therewith. Additionally, notches such as those of the first portion 38 are not provided in the step-shaped second portion 39 and target heating portion support section 36. In this case, notches may also be provided in the second portion 39.

Incidentally, when the non-winding mode is executed, the roll-shaped medium 2 is not linked to the winding unit 25, and as shown in FIG. 5, a leading end E in the transport direction of the roll-shaped medium 2 is in a free state. Therefore, roll-shaped medium 2 that is positioned above the downstream side support member 35 always runs over the downstream side support member 35 as a result of gravity. Therefore, the roll-shaped medium 2 is in contact with the contact portions 36*a* of the target heating portion support section 36 that is provided with a stepped shape.

Meanwhile, since the roll-shaped medium 2 is linked to the winding unit when the winding mode is executed, a leading end in the transport direction of the roll-shaped medium 2 is not in a free state. Therefore, as can be understood from FIG. 6, a position at which the roll-shaped medium 2 that is above the downstream side support member 35 is positioned is dependent on the positions of the second transport roller 24 and the relay roller 26 (that is, the positions of the second transport roller 24 and the relay roller 26 determine the position of the roll-shaped medium 2). Therefore, depending on the size (such as a case in which the steps are small steps) of the steps of the target heating portion support section 36 that is provided with a stepped shape, a state in which the roll-shaped medium 2 does not run over the downstream side support member 35 is possible.

However, in the embodiment, the size of the steps is set to a suitable size, and as shown in FIG. 6, and the roll-shaped medium 2 is also in contact with the contact portions 36*a* of the target heating portion support section 36 that is provided with a stepped shape when the winding mode is executed.

Effectiveness of Printer 1 According to the Embodiment

In the manner described above, the printer 1 according to the embodiment is configured to have a heater 40 that heats a roll-shaped medium 2, and a target heating portion support section 36 that supports a target heating portion of the roll-shaped medium 2, which is a portion that is heated by the heater 40. Further, in the printer 1, the target heating portion support section 36 is configured to be provided with depressed portions 36*b* that are formed so that an airspace (an air layer 80) is provided between the target heating portion support section 36 and the roll-shaped medium 2 when the roll-shaped medium 2 is supported, and the contact portions 36*a* that are in contact with the roll-shaped medium 2 when the roll-shaped medium 2 is supported. Therefore, it is possible to suitably perform the heating of the roll-shaped medium 2.

In a comparative example (an example of the related art), the target heating portion support section 36 is not provided with the contact portions 36*a* and the depressed portions 36*b*, and is flat. Therefore, the roll-shaped medium 2 that is positioned above the target heating portion support section 36 is supported by the target heating portion support section 36 in a state in which substantially the entire surface of the target heating portion support section 36 is in contact with the roll-shaped medium 2. Considering this, in such a case, the following problems occurred.

That is, there was a problem in that heating of the roll-shaped medium 2 was not performed suitably due to that fact that heat was lost (the loss of heat was significant since the contact region was large) from the target heating portion to the target heating portion support section 36, substantially the entire surface of which is in contact with the target heating portion when the target heating portion of the roll-shaped medium 2 was heated by the heater 40. That is, a great deal of energy was necessary from the heater 40 in order for the roll-shaped medium 2 to reach a desired temperature.

In contrast to this, in the embodiment, since the contact portions 36*a* and the depressed portions 36*b* are provided in the target heating portion support section 36, the abovementioned contact region is reduced by a great deal, and a phenomenon in which heat is lost through the contact region is suppressed. In addition, the air layer 80 that is formed between the roll-shaped medium 2 and the depressed portions 36*b* performs a role of inhibiting the movement of heat from the target heating portion of the roll-shaped medium 2 to the target heating portion support section 36 (that is, the air layer 80 exhibits a thermal insulating effect). Therefore, a saving of energy is achieved in the heater 40, and the heating of the roll-shaped medium 2 is performed suitably.

Furthermore, since a contact area is reduced as a result of providing the contact portions 36*a* and the depressed portions 36*b*, the additional merits that are described below are achieved.

That is, when the roll-shaped medium 2 is heated, there are cases in which the roll-shaped medium 2 has a viscous property, and a phenomenon in which the resilience of the roll-shaped medium 2 is weakened occurs (this kind of phenomenon occurs in particular, in cases in which the roll-shaped medium 2 is a tarpaulin or case in which the roll-shaped medium 2 is a sticker release paper with an adhesive). Further, in a comparative example (an example of the related art), when the abovementioned phenomenon occurred, since the contact area was large, a problem in which the roll-shaped medium 2 stuck to the target heating portion support section 36 occurred. In contrast to this, in the embodiment, since the contact area has been reduced, it is possible to suppress the occurrence of such a problem.

In addition, in the embodiment, a cross-section of the target heating portion support section 36 that has a girder direction (a width direction of the medium) as the normal line thereof is configured to have a stepped shape.

Therefore, it is possible to suitably realize a configuration of a target heating portion support section 36 in which the abovementioned air layer 80 is formed.

In addition, the printer 1 according to the embodiment has the feed unit 10 that is provided with a roll-shaped medium rolling shaft 18 upon which a roll-shaped medium 2 is rolled, and which feeds the roll-shaped medium 2, and the winding unit 25 that is provided with a roll-shaped medium winding drive shaft 27 upon which a roll-shaped medium 2 is rolled, and which winds the roll-shaped medium 2, and in a state in which the roll-shaped medium 2 is rolled around both the roll-shaped medium rolling shaft 18 and the roll-shaped medium winding drive shaft 27, the roll-shaped medium 2 is configured so as to be in contact with the contact portions 36*a* of the target heating portion support section 36.

Therefore, when the winding mode is executed, downward sag (in other words, bending as a result of gravity) of a roll-shaped medium 2 that has been deformed by heating is suitably suppresses due to being physically blocked by the contact portions 36*a*.

Other Embodiments

The abovementioned embodiment facilitates the understanding of the invention, and should not be interpreted in a manner that limits the invention. Naturally, provided they do not depart from the scope thereof, in addition to modifications and improvements, the invention can include equivalents. In particular, the embodiments described below can be included in the invention.

In the abovementioned embodiment, a liquid discharging apparatus was given as an example of a medium heating device, but the invention is not limited thereto and may be any device provided it is a device that has a function of heating a medium.

In addition, an ink jet type printer was specified as a liquid discharging apparatus (liquid ejecting apparatus), but a liquid ejecting apparatus that ejects or discharges another liquid other than ink can be adopted, and the invention is appropriable in various liquid ejecting apparatuses that are provided with liquid spray heads that discharge minute amounts of liquid droplets or the like. Additionally, liquid droplets refer to the state of liquid that is discharged from the abovementioned liquid ejecting apparatuses, and may include droplets have a lasting effect as a granular form, tear form or string form. In addition, the liquid that is referred to here may be any material that can be sprayed by a liquid ejecting apparatus. For example, the liquid may be any substance that is in a state in which it is in the liquid phase, and may include liquids in which particles of organic material that are formed from solid matter such as pigment or metal particles are dissolved, dispersed, or mixed into a solvent in addition to liquid states with low or high viscosities, fluid states such as sols, gel waters, other inorganic solvents, organic solvents, liquid solutions, liquid resins, liquid metals (metallic melts) or substances in a single state. In addition, an ink or liquid crystal such as that described in the abovementioned embodiment can be given as a representative example of the liquid. In this case, ink can include various liquid compositions such as a general water-based ink or oil-based ink, a gel ink, or a hot melt ink. As a specific example of a liquid ejecting apparatus, for example, it is possible to include liquid ejecting apparatuses that spray liquids that includes materials such as electrode materials and color materials, which are used in the manufacturing of liquid crystal displays, EL (electroluminescence) displays, surface-emitting displays, color filters and the like in a dispersed or dissolved form, liquid ejecting apparatuses that spray living organic material that is used in the manufacture of biochips, or liquid ejecting apparatuses, printing equipment or microdispensers that spray liquids that form specimens that are used as precision pipettes. Furthermore, it is possible to adopt a liquid ejecting apparatus that ejects a lubricating oil with pinpoint precision in a precision instrument such as a watch or a camera, a liquid ejecting apparatuses that ejects a transparent resin liquid such as an ultraviolet curable resin for forming a microhemispherical lens (optical lens) or the like that is used in optical communication elements or the like onto a substrate, or a liquid ejecting apparatuses that ejects an etching liquid such as an acid or an alkali for etching a substrate or the like. Further, it is possible to adopt the invention in any one of these ejecting apparatuses.

In addition, in the embodiment, the transport unit 20 was configured to have the first transport roller 23 that is positioned further on the upstream side of the transport direction than the head 30, and the second transport roller 24 that is positioned further on the downstream side of the transport direction than the head 30, but the number of transport rollers and the positions thereof are not limited to this configuration.

In addition, in the embodiment, an example that used a roll-shaped medium 2 as an example of the medium was used, but the medium may be single sheets of medium. In the case of single sheets of medium, the air layer 80 that is formed between the medium and the depressed portions 36*b* also performs a role of inhibiting the movement of heat from the target heating portion of the medium to the target heating portion support section 36 (that is, the air layer 80 exhibits a thermal insulating effect). Therefore, a saving of energy is achieved in the heater 40, and the heating of the medium is performed suitably.

Figure 7:
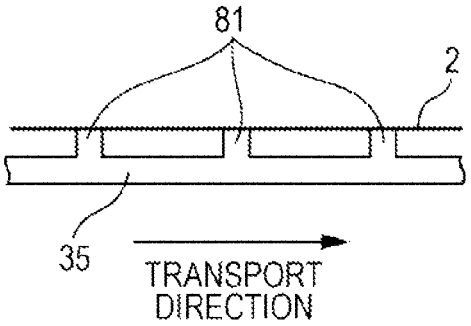
FIG. 7 is a schematic view that shows a form according to a modification example of the downstream side support member.

In addition, in the embodiment, the downstream side support member 35 was configured to be provided with a stepped shape, but the downstream side support member 35 may be provided with a shape that has a plurality of ribs such as those shown in FIG. 7 instead of the stepped shape.

Figure 8:
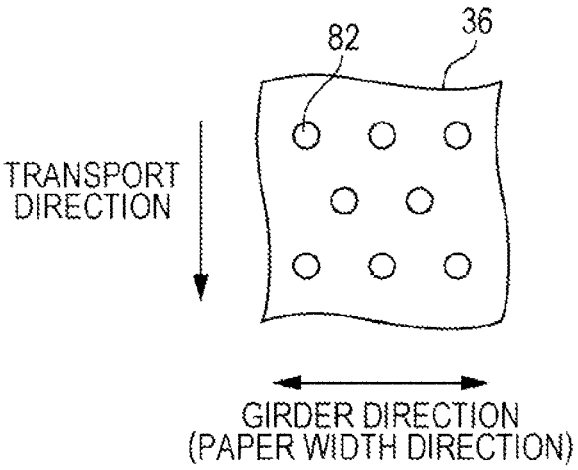
FIG. 8 is a schematic view that shows an example in which protruding portions are provided in a target heating portion support section in zigzag form.

In addition, the target heating portion support section 36 according to the embodiment was configured to be provided with the contact portions 36*a* and the depressed portions 36*b* in the transport direction, and to be flat in the girder direction (the width direction of the medium), but the target heating portion support section 36 is not limited thereto and for example, an example in which the target heating portion support section 36 is provided with the contact portions 36*a* and the depressed portions 36*b* in the girder direction (the width direction of the medium), and is flat in the transport direction may be used, or as shown in FIG. 8, an example in which the target heating portion support section 36 is provided with the contact portions 36*a* and the depressed portions 36*b* in both directions is also possible. Additionally, the example of FIG. 8 is an example in which protruding portions 82 that protrude from the target heating portion support section 36 in a direction that is orthogonal with a surface of the target heating portion support section 36 are provided in zigzag form. In this case, the protruding portions 82 correspond to the contact portions 36*a* (the second component portion), and the portions of the target heating portion support section 36 in which the protruding portions 82 are not provided correspond to the depressed portions 36*b* (the first component portion), which are depressed with respect to the contact portions 36*a* in a direction that is separated from the roll-shaped medium 2.

However, the example in which the target heating portion support section 36 is provided with the contact portions 36*a* and the depressed portions 36*b* in the transport direction and is flat in the girder direction (the width direction of the medium) has the merits that are described below in comparison with the two abovementioned modification examples in which the target heating portion support section 36 is provided with the contact portions 36*a* and the depressed portions 36*b* in the girder direction (the width direction of the medium).

That is, in the modification examples in which the target heating portion support section 36 is provided with the contact portions 36*a* and the depressed portions 36*b* in the girder direction (the width direction of the medium), there is a possibility that the shape of the roll-shaped medium 2 will conform to the shape of the target heating portion support section 36 (the shape of the target heating portion support section 36 will be embossed in the roll-shaped medium 2) when the roll-shaped medium 2 is heated. On the other hand, in the example in which the target heating portion support section 36 is provided with the contact portions 36*a* and the depressed portions 36*b* in the transport direction, since the relative position of the roll-shaped medium 2 with respect to the contact portions 36*a* and the depressed portions 36*b* in the transport direction changes regularly due to the roll-shaped medium 2 moving in the transport direction, it is unlikely that the abovementioned problem will occur (in the modification example, even if the roll-shaped medium 2 moves in the transport direction, the relative position of the roll-shaped medium 2 with respect to the contact portions 36*a* and the depressed portions 36*b* in the girder direction does not change).

Therefore, the example is more preferable.

In addition, in the abovementioned embodiment, the non-target heating portion support section 37 is configured to be provided with notches 38*a*, and the reason for this will be described below.

That is, the non-target heating portion support section 37 is different from the target heating portion support section 36, and since it is not necessary for the non-target heating portion support section 37 to have a configuration for achieving a saving of energy in the heater 40, it is not necessary to form an air layer 80 that exhibits a thermal insulating effect. Therefore, the non-target heating portion support section 37 is configured to be provided with notches 38*a* that are more easily-worked than making a stepped shape. Further, if the non-target heating portion support section 37 is provided with notches 38*a*, since it is possible to reduce the contact area in the same manner as the stepped shape, it is possible to suppress the occurrence of a problem in which the roll-shaped medium 2 becomes stuck to the non-target heating portion support section 37.

Additionally, since the notches 38*a* are advantageous in the feature of suppressing the problem in which the roll-shaped medium 2 becomes stuck using a simple process, a form in which only the notches 38*a* are provided in the non-target heating portion support section 37 is more preferable.

However, as shown in FIG. 6 (the example), the present embodiment is not an embodiment that prevents providing a stepped shape in the non-target heating portion support section 37. In addition, a shape that has a plurality of ribs such as those shown in FIG. 7 may be provided in the non-target heating portion support section 37 instead of the stepped shape.

The entire disclosure of Japanese Patent Application No. 2013-009020, filed Jan. 22, 2013 is expressly incorporated by reference herein.

What is claimed is:

1. A medium heating device comprising:

a heater that heats a medium; and a medium support member that supports a target heating portion, which is a portion that is heated by the heater in the medium, wherein the medium support member is downstream of an ejecting head that ejects liquid onto the medium, wherein the target heating portion of the medium support member includes:

a first component portion that is formed so that a space is provided between the medium and the first component portion when the medium is supported, a second component portion that is in contact with the medium when the medium is supported, and wherein the medium support unit includes a first non-target heating portion that is upstream of the target heating portion, the first non-target heating portion including a planar portion with a plurality of notches having a longitudinal direction along a transport direction of the medium and being lined up in width direction of the medium, a terminal end of each notch of the plurality of notches terminating upstream of a terminal end of the first non-target heating portion such that a shape of a surface of the first non-target heating portion is different from a shape of a surface of the target heating portion, wherein the medium support unit includes a second non-target heating portion different from the first non-target heating portion and that is downstream of the target heating portion and that includes the first and second component portions, a plane of the planar portion being aligned with the second component portion that contacts the medium.

2. The medium heating device according to claim 1, wherein the first component portion is formed so as to become depressed with respect to the second component portion in a direction that is separated from the medium when the medium support member supports the medium.

3. The medium heating device according to claim 1, further comprising:

a transport portion that transports the medium in a transport direction, wherein a plurality of the first component portions and second component portions are provided in the medium support member along the transport direction.

4. The medium heating device according to claim 3, wherein the first component portion and the second component portion are provided alternately in the medium support member.

5. The medium heating device according to claim 4, wherein a cross-section of the medium support member that has an intersecting direction as the normal line thereof is step-shaped.

6. The medium heating device according to claim 1 further comprising:

a feeding portion that feeds the medium and is provided with a first shaft around which the medium is rolled; and a winding portion that winds the medium and is provided with a second shaft around which the medium is rolled, wherein, in a state in which the medium is rolled on both the first shaft and the second shaft, the medium is in contact with the second component portion of the medium support member.

* * * * *